US011134558B2

(12) United States Patent
Tu et al.

(10) Patent No.: US 11,134,558 B2
(45) Date of Patent: Sep. 28, 2021

(54) DROPLET GENERATOR ASSEMBLY AND METHOD FOR USING THE SAME AND RADIATION SOURCE APPARATUS

(71) Applicant: TAIWAN SEMICONDUCTOR MANUFACTURING CO., LTD., Hsinchu (TW)

(72) Inventors: Shih-Yu Tu, Hsinchu County (TW); Yu-Kuang Sun, Hsinchu (TW); Shao-Hua Wang, Taoyuan (TW); Han-Lung Chang, Kaohsiung (TW); Hsiao-Lun Chang, Tainan (TW); Li-Jui Chen, Hsinchu (TW); Po-Chung Cheng, Chiayi County (TW); Cheng-Hao Lai, Taichung (TW); Hsin-Feng Chen, Yilan (TW); Wei-Shin Cheng, Hsinchu (TW); Ming-Hsun Tsai, Hsinchu (TW); Yen-Hsun Chen, Taipei (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 35 days.

(21) Appl. No.: 16/508,596

(22) Filed: Jul. 11, 2019

(65) Prior Publication Data

US 2020/0107427 A1 Apr. 2, 2020

Related U.S. Application Data

(60) Provisional application No. 62/738,739, filed on Sep. 28, 2018.

(51) Int. Cl.
*H05G 2/00* (2006.01)

(52) U.S. Cl.
CPC ..... *H05G 2/006* (2013.01); *H05G 2/008* (2013.01)

(58) Field of Classification Search
CPC ..... H05G 2/006; H05G 2/008
USPC ..... 250/493.1, 504 R
See application file for complete search history.

(56) References Cited

U.S. PATENT DOCUMENTS

| | | | | |
|---|---|---|---|---|
| 8,154,000 | B2 * | 4/2012 | Hergenhan | H05G 2/005 250/504 R |
| 9,018,604 | B2 * | 4/2015 | Niimi | H05G 2/008 250/493.1 |
| 10,495,974 | B2 * | 12/2019 | Tsai | G03F 7/2004 |
| 2006/0192155 | A1 * | 8/2006 | Algots | H05G 2/005 250/504 R |

* cited by examiner

*Primary Examiner* — Michael Maskell
(74) *Attorney, Agent, or Firm* — Maschoff Brennan

(57) ABSTRACT

A droplet generator assembly includes a storage tank, a refill system, a droplet generator, and a temperature control system. The storage tank is configured to store a target material. The refill system is connected to the storage tank. The droplet generator includes a reservoir and a nozzle connected to the reservoir, in which the droplet generator is connected to the refill system, and the refill system is configured to deliver the target material to the reservoir. The temperature control system is adjacent to the refill system or the reservoir.

20 Claims, 15 Drawing Sheets

DROPLET GENERATOR ASSEMBLY AND METHOD FOR USING THE SAME AND RADIATION SOURCE APPARATUS

PRIORITY CLAIM AND CROSS-REFERENCE

This application claims priority to U.S. Provisional Application Ser. No. 62/738,739, filed Sep. 28, 2018, which is herein incorporated by reference.

BACKGROUND

Photolithography is a process by which a reticle having a pattern is irradiated with light to transfer the pattern onto a photosensitive material overlying a semiconductor substrate. Over the history of the semiconductor industry, smaller integrated chip minimum features sizes have been achieved by reducing the exposure wavelength of optical lithography radiation sources to improve photolithography resolution. Extreme ultraviolet (EUV) lithography, which uses extreme ultraviolet (EUV) light is a promising next-generation lithography solution for emerging technology nodes.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
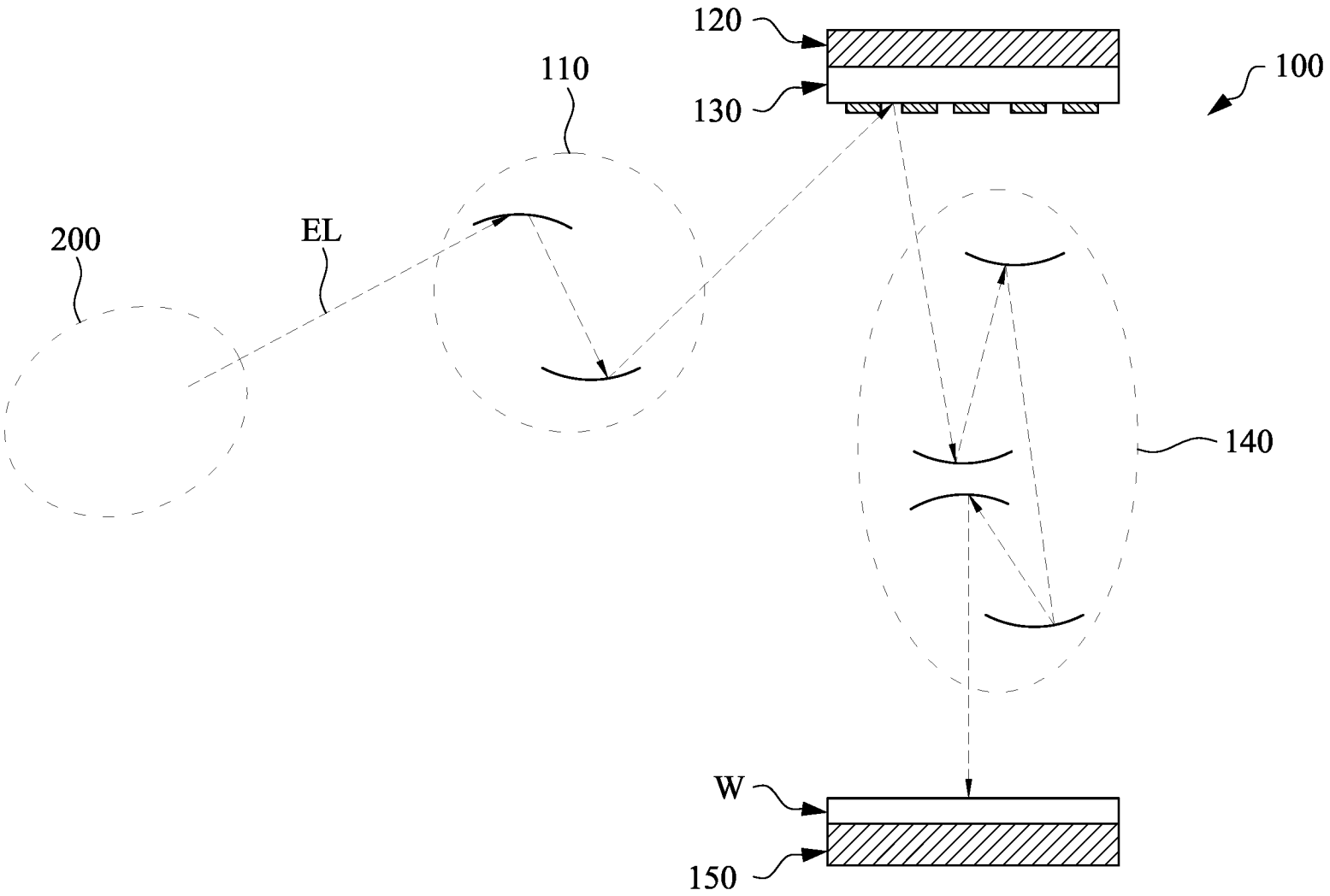
FIG. 1 is a schematic view of a lithography system according to some embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

An extreme ultraviolet (EUV) photolithography system uses extreme ultraviolet radiation having a wavelength between about 10 nm and about 130 nm. One method of producing the extreme ultraviolet radiation is to fire a carbon dioxide ($CO_2$) laser at droplets of tin (Sn). The tin droplets are dropped into an EUV source vessel. As the droplets fall into the EUV source vessel, the $CO_2$ laser hits the tin droplets and heats the tin droplets to a critical temperature that causes atoms of tin to shed their electrons and become a plasma of ionized tin droplets. The ionized tin droplets emit photons having a wavelength between about 1 nm and about 100 nm, which is provided as EUV radiation to an optical lithography system.

FIG. 1 is a schematic view of a lithography system 100 according to some embodiments of the present disclosure. The lithography system 100 may also be referred to as a scanner that is operable to perform lithography exposure processes. In some embodiments, the lithography system 100 is an extreme ultraviolet (EUV) lithography system designed to expose a resist layer by EUV light (or EUV radiation). The resist layer is a material sensitive to the EUV light. The EUV lithography system 100 employs a radiation source 200 to generate EUV light EL, such as EUV light having a wavelength ranging between about 1 nm and about 100 nm. In some example, the EUV light EL has a wavelength range centered at about 13.5 nm. Accordingly, the radiation source 200 is also referred to as an EUV radiation source 200. The EUV radiation source 200 may utilize a mechanism of laser-produced plasma (LPP) to generate the EUV radiation, which will be further described later.

The lithography system 100 also employs an illuminator 110. In some embodiments, the illuminator 110 includes various reflective optics such as a single mirror or a mirror system having multiple mirrors in order to direct the light EL from the radiation source 200 onto a mask stage 120, particularly to a mask 130 secured on the mask stage 120.

The lithography system 100 also includes the mask stage 120 configured to secure the mask 130. In some embodiments, the mask stage 120 includes an electrostatic chuck (e-chuck) used to secure the mask 130. In this context, the terms mask, photomask, and reticle are used interchangeably. In the present embodiment, the lithography system 100 is an EUV lithography system, and the mask 130 is a reflective mask. One exemplary structure of the mask 130 includes a substrate with a low thermal expansion material (LTEM). For example, the LTEM may include $TiO_2$ doped SiO2, or other suitable materials with low thermal expansion. The mask 130 includes a reflective multi-layer (ML) deposited on the substrate. The ML includes a plurality of film pairs, such as molybdenum-silicon (Mo/Si) film pairs (e.g., a layer of molybdenum above or below a layer of silicon in each film pair). Alternatively, the ML may include molybdenum-beryllium (Mo/Be) film pairs, or other suitable materials that are configurable to highly reflect the EUV light EL. The mask 130 may further include a capping layer, such as ruthenium (Ru), disposed on the ML for protection. The mask 18 further includes an absorption layer, such as a tantalum boron nitride (TaBN) layer, deposited over the ML. The absorption layer is patterned to define a layer of an integrated circuit (IC). The mask 130 may have other structures or configurations in various embodiments.

The lithography system 100 also includes a projection optics module (or projection optics box (POB)) 140 for imaging the pattern of the mask 130 onto a semiconductor substrate W secured on a substrate stage (or wafer stage) 150 of the lithography system 100. The POB 140 includes reflective optics in the present embodiment. The light EL that is directed from the mask 130 and carries the image of the pattern defined on the mask 130 is collected by the POB 140. The illuminator 110 and the POB 140 may be collectively referred to as an optical module of the lithography system 100. In the present embodiment, the semiconductor substrate W is a semiconductor wafer, such as a silicon wafer or other type of wafer to be patterned. The semiconductor substrate W is coated with a resist layer sensitive to the EUV light EL in the present embodiment. Various components including those described above are integrated together and are operable to perform lithography exposing processes.

Figure 2:
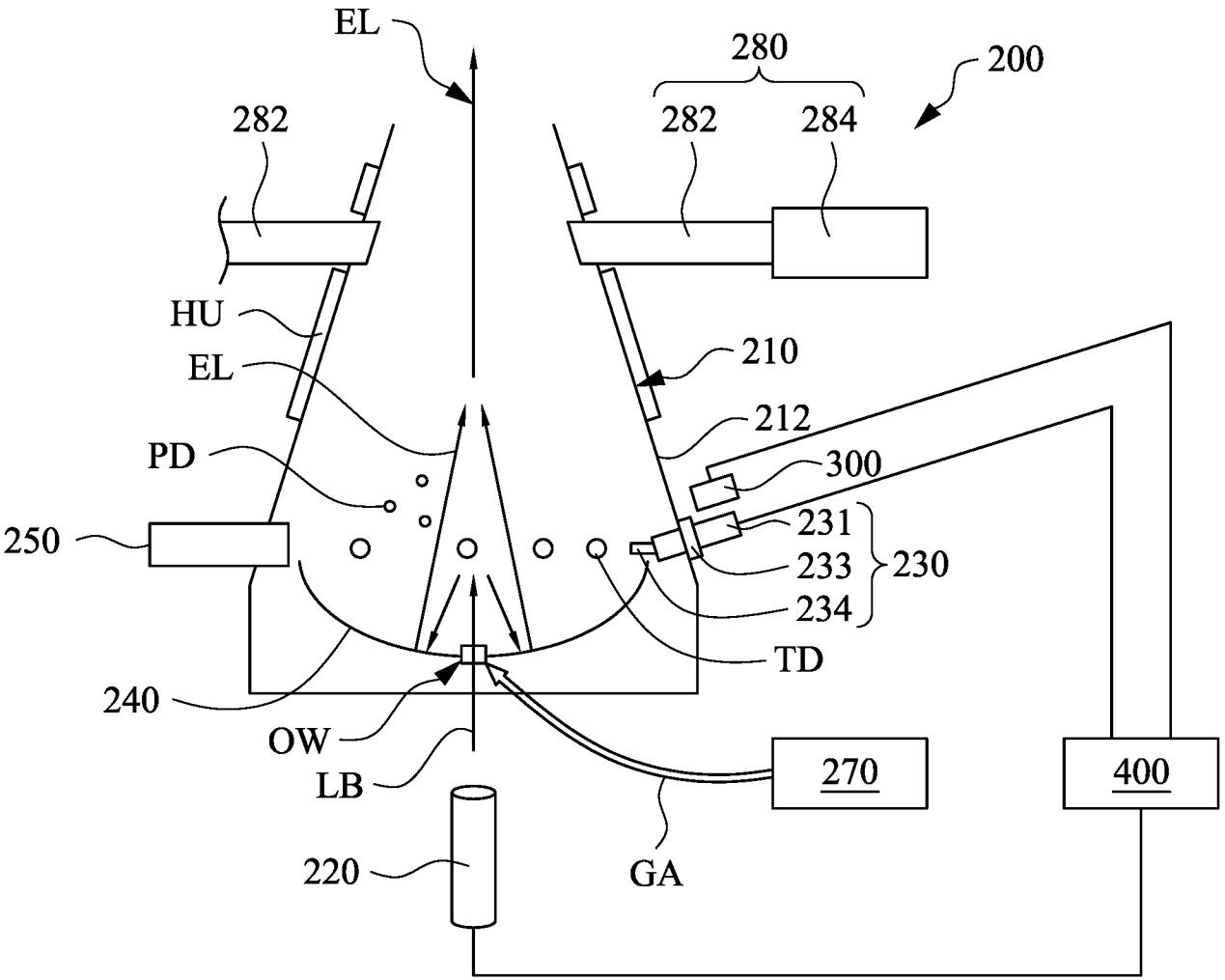
FIG. 2 is a schematic view of an EUV radiation source according to some embodiments of the present disclosure.

FIG. 2 is a schematic view of an EUV radiation source 200 according to some embodiments of the present disclosure. The radiation source 200 employs a laser produced plasma (LPP) mechanism to generate plasma and further generate EUV light from the plasma. The radiation source 200 includes a vessel 210, a laser source 220, a target droplet generator 230, a LPP collector 240, and a droplet catcher 250.

The target droplet generator 230 generates plural target droplets TD, which are introduced into a space in the vessel 210 of the radiation source 200. In some embodiments, the target droplets TD are tin (Sn) droplets. Other materials may also be used for the target droplets TD, for example, a tin-containing liquid material such as eutectic alloy containing tin, lithium (Li), and xenon (Xe). In the present embodiments, a temperature control system 300 may be arranged adjacent to or connected to the droplet generator 230, in which the temperature control system 300 is at least configured for cooling the droplet generator 230. In some embodiments, the temperature control system 300 may be configured for cooling and heating the droplet generator 230.

The laser source 220 may include a carbon dioxide ($CO_2$) laser source, a neodymium-doped yttrium aluminum garnet (Nd:YAG) laser source, or another suitable laser source to generate a laser beam LB. The laser beam LB is directed through an output window OW integrated with the collector 240. The output window OW adopts a suitable material substantially transparent to the laser beam LB. The laser beam LB is directed to heat the target droplets TD, such as tin droplets, thereby generating high-temperature plasma which further produces the EUV light EL. The pulses of the laser source 220 and the droplet generating rate of the droplet generator 230 are controlled to be synchronized such that the target droplets TD receive peak powers consistently from the laser pulses of the laser source 220.

The EUV light EL is collected by the collector 240, which further reflects and focuses the EUV light EL for the lithography exposure processes. The collector 240 is designed with suitable coating material and shape, functioning as a mirror for EUV collection, reflection, and focus. In some examples, the collector 240 is designed to have an ellipsoidal geometry. In some examples, the coating material of the collector 240 is similar to the reflective multilayer of the EUV mask 130 (referring to FIG. 1). In some examples, the coating material of the collector 240 includes a ML (such as a plurality of Mo/Si film pairs) and may further include a capping layer (such as Ru) coated on the ML to substantially reflect the EUV light. In some examples, the collector 240 may further include a grating structure designed to effectively scatter the laser beam directed onto the collector 240. For example, a silicon nitride layer may be coated on the collector 240 and patterned to have a grating structure.

In some embodiments, the laser beam LB may or may not hit every target droplet TD. For example, some target droplets TD may be purposely missed by the laser beam LB. In the present embodiments, the droplet catcher 250 is installed opposite the target droplet generator 230 and in the direction of the movement of the target droplets TD. The droplet catcher 250 is configured to catch any target droplets that are missed by the laser beam LB.

In some embodiments, the high-temperature plasma may cool down and become vapors or small particles (collectively, debris) PD. The debris PD may deposit onto the surface of the collector 240, thereby causing contamination thereon. Over time, the reflectivity of the collector 240 degrades due to debris accumulation and other factors such as ion damages, oxidation, and blistering. Once the reflectivity is degraded to a certain degree, the collector 240 reaches the end of its usable lifetime and may need to be swapped out.

The vessel 210 has a cover 212 surrounded itself for ventilation and for collecting debris PD. In some embodiments, the cover 212 is made of a suitable solid material, such as stainless steel. The cover 212 is designed and configured around the collector 240. The cover 212 may include a plurality of vanes, which are evenly spaced around the cone-shaped cover 212. In some embodiments, the radiation source 200 further includes a heating unit HU configured around part of the cover 212. The heating unit HU functions to maintain the temperature inside the cover 212 above a melting point of the debris PD so that the debris PD does not solidify on the inner surface of the cover 212. When the debris PD vapor comes in contact with the vanes, it may condense into a liquid form and flow into a lower section of the cover 212. The lower section of the cover 212 may provide holes (not shown) for draining the debris liquid out of the cover 212.

In some embodiments, the radiation source 200 further includes a gas flow mechanism, including a gas supply module 270, an exhaust system 280, and various pipelines for integrating the gas flow mechanism with the collector 240. The gas supply module 270 is configured to provide a gas GA into the vessel 210 and particularly into a space proximate the reflective surface of the collector 240. In some embodiments, the gas GA is hydrogen gas, which has less absorption to the EUV radiation. The gas GA is provided for various protection functions, which include effectively protecting the collector 240 from the contaminations by tin particles. Other suitable gas may be alternatively or additionally used. The gas GA may be introduced into the collector 240 through openings (or gaps) near the output window OW through one or more gas pipelines. The exhaust system 280 includes one or more exhaust lines 282 and one or more pumps 284. The exhaust line 282 is connected to the wall of the vessel 210 for receiving the exhaust. In some embodiments, the cover 212 is designed to have a cone shape with its wide base integrated with the collector 240 and its narrow top section facing the illuminator 110 (FIG. 1). To further these embodiments, the exhaust line 282 is connected to the cover 212 at its top section. Installing the exhaust line 282 at the top section of the cover 212 helps get the remaining portion of the debris PD out of the space defined by the collector 240 and the cover 212.

The radiation source 200 is configured in an enclosed space in the vessel 210. The space in the vessel 210 is maintained in a vacuum environment since the air absorbs the EUV radiation. The radiation source 200 may include other components. For example, it may include a central obscuration (not shown) designed and configured to obscure the laser beam LB; and it may include an intermediate focus (IF)-cap module (not shown) configured to provide intermediate focus to the EUV radiation EL.

Figure 3:
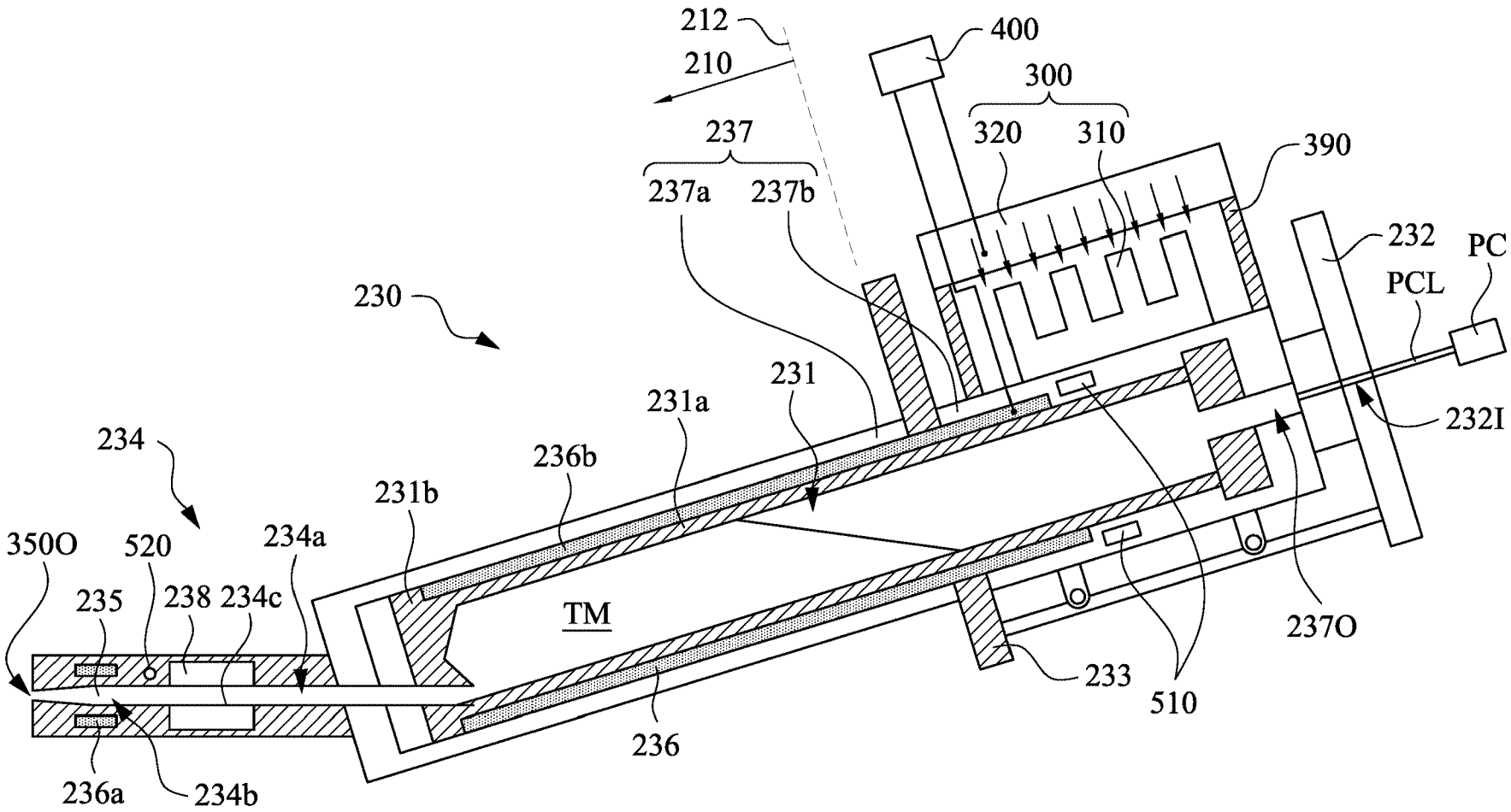
FIG. 3 is a schematic view of a droplet generator assembly according to some embodiments of the present disclosure.

FIG. 3 is a schematic view of a droplet generator assembly according to some embodiments of the present disclosure. The droplet generator assembly includes the droplet generator 230 and the temperature control system 300. The droplet generator 230 includes a reservoir 231, a cover 232, a capillary tube 234, heating elements 236*a* and 236*b*, and an outer shell 237. The elements of the droplet generator 230 can be added to or omitted.

The reservoir 231 is configured for holding the target material TM. The reservoir 231 may include a sidewall 231*a* and a bottom wall 231*b*. The sidewall 231*a* may be made of steel (e.g., stainless steel) or other suitable thermal conductive material. The sidewall 231*a* surrounds the outer edge of the bottom wall 231*b* and extends away from the bottom wall 231*b*. The heating elements 236*b* may surround the reservoir 231 for heating the target material TM and keeping the target material TM at a temperature above a melting point of the target material TM for generating liquid droplets. For example, during operation of the EUV radiation source 200 (referring to FIG. 2), the temperature of the tin target material TM may be kept in an operable range of about 231° C. to about 300° C., or up to about 2602° C., such that the tin target material TM melts and does not vaporize. The outer shell 237 surrounds the reservoir 231 and the heating elements 236*b*. The outer shell 237 may be made of steel (e.g., stainless steel) or other suitable thermal conductive material. The outer shell 237 may have an inlet 2370 allowing the target material TM flow through to the reservoir 231. The cover 232 is connected to the upper end of the outer shell 237 for covering the inlet 2370, and the cover 232 may be removable from the inlet 2370.

In some embodiments, one gas inlet 2321 and one gas outlet (not shown) are formed on the cover 232. The gas inlet 2321 is connected to a gas line PCL for introducing pumping gas, such as argon, into the reservoir 231. For example, a pressurizing device PC is configured to supply gas into the reservoir 231 through the gas line PC. The gas outlet is connected to a gas line and a pump (not shown) for pumping out the gas in the reservoir. By controlling the gas flow in the gas lines connected to the gas inlet 2321 and the gas outlet, the pressure in the reservoir 231 can be manipulated. For example, when gas is continuously supplied into the reservoir 231 via the gas inlet 2321 and when the gas outlet is blocked and not exhausting gas, the pressure in the reservoir 231 increases. As a result, the target material TM in the reservoir 231 can be forced out of the reservoir 231.

The capillary tube 234 includes a first end 234*a*, a second end 234*b*, and a sidewall 234*c*. The sidewall 234*c* is between the first end 234*a* and the second end 234*b*. The first end 234*a* is coupled, directly or indirectly, to the reservoir 231 that holds the target material TM. The second end 234*b* includes a nozzle 235 that defines an orifice 2350 through which the target material TM escapes to form the target droplets TD of the target material TM (referring to FIG. 2). The output of the target droplets TD (referring to FIG. 2) can be controlled by an actuator such as a piezoelectric actuator 238 surrounding the capillary tube 234. In some embodiments, some of the heating elements 236*a* surround the capillary tube 234 for heating the target material TM and keeping the target material TM at a temperature above the melting point of the target material TM for generating the liquid droplets.

In some embodiments, the droplet generator 230 includes a holder 233 connected to the outer shell 237, and the outer shell 237 has portions 237*a* and 237*b* on opposite sides of the holder 233. The temperature control system 300 is at least partially over the portion 237*b* of the outer shell 237. When the droplet generator 230 is inserted into the vessel 210 of the radiation source 200 (referring to FIG. 2), the holder 233 may be in contact with the cover 212 (referring to FIG. 2) and relatively fix a position of the droplet generator 230 in the vessel 210 (referring to FIG. 2). For example, the dashed line in FIG. 3 indicate an outer edge of the cover 212 when the droplet generator 230 is inserted into the vessel 210 (referring to FIG. 2). To be specific, when the droplet generator 230 is inserted into the vessel 210, a portion of the reservoir 231, the portion 237*a* of the outer shell 237 and the capillary tube 234 are in the vessel 210, while the other portion of the reservoir 231, the portion 237*b* of the outer shell 237, the holder 233, and the temperature control system 300 are out of the vessel 210.

In some cases, when the target material TM in the reservoir 231 is exhausted, a refill process is performed. The refill process includes cooling down the reservoir 231, filling the target material into the reservoir 231, and reheating the reservoir 231, in which the cooling down and reheating steps takes a long time. To be specific, it takes several hours to reduce the temperature of the target material TM/the droplet generator 230 from the operable temperature (e.g., from about 231° C. to about 300° for tin) to a refill temperature lower than the operable temperature, in which the refill temperature may be lower than the melting point of the target material TM. For example, for tin target material TM, the refill temperature may be in a range from about 0° C. to about 210° C., such that operators may then refill target material TM manually and the tin does not vaporize.

In some cases, contaminations in the target material TM may result in clogging (i.e., at least partial blocking) of the nozzle 235, which may impose a lifetime limit on the nozzle 235 and thus the droplet generator 230, such that a maintenance, replacement, or cleaning process (which are in combination briefly referred to as a maintenance process hereinafter) for the droplet generator 230 is performed on a weekly basis. The prevention maintenance process includes depressurizing, cooling down, disassembly, reassembly, and reheat, in which the cooling down and reheating steps also takes a long time. To be specific, it takes several hours to reduce the temperature of the target material TM/the droplet generator 230 from the operable temperature (e.g., from about 231° C. to about 300° for tin) to a maintenance temperature lower than the operable range, such that the operator can detach the droplet generator 230 from the vessel 210 and mount a new droplet generator 230 onto the vessel 210. For example, for tin target material TM, the prevention maintenance temperature may be in a range from about 0° C. to about 130° C., such that operators may perform the maintenance process manually and the tin does not vaporize. As such, the refill process and the prevention maintenance process take a long process time.

In some embodiments of the present disclosure, the temperature control system 300 is disposed adjacent to the reservoir 231 for accelerating the cool down process. The temperature control system 300 may include a passive heat dissipation device (e.g., a heat sink 310) and an active heat dissipation device (e.g., the fan 320). The heat sink 310 is capable of absorbing heats of the reservoir 231 and dissipates the heat by its fins. For example, the heat sink 310 may be mounted on the portion 237*b* of the outer shell 237. In some embodiments, the heat sink 310 is in contact with the portion 237*b* of the outer shell 237. The fan 320 may be fixed with respect to the droplet generator 230. For example, herein, the temperature control system 300 may include a bracket 390 supports the fan 320 and connects the fan 320 to the outer shell 237. The fan 320 is disposed on a side of the fins of the heat sink 310 for generating gas flow to accelerate the heat dissipation. In some embodiments, the gas flow may be in a direction normal to the portion 237*b* of the outer shell 237. In some embodiments, the gas flow may be in a direction inclined with respect to the portion 237*b* of the outer shell 237. Exemplary fan 320 may be a single fan, a multi fan (e.g., a double fan, a triple fan, or a quadruple fan), an industry-fan, a high-power Fan, or a Turbo Fan. In some embodiments, the droplet generator 230 may optionally include a temperature control circuit or controller 400 electrically connected to the heating elements 236*a* and 236*b* and the fan 320 for modulating the temperature of the droplet generator 230. In some other embodiments, the passive heat dissipation device (e.g., a heat sink 310) can be omitted. In some other embodiments, the active heat dissipation device (e.g., the fan 320) can be omitted.

Through the configuration of the temperature control system 300, the target material TM in the reservoir 231 may be fast cooled, and the refill process and the prevention maintenance process take less process time, such that the yield rate is increased. Due to the short refill time and/or the short maintenance time, the contamination or particle in the vessel 210 or on the collector 240 can be effectively reduced. Furthermore, due to the short refill time and/or the short maintenance time, it is less likely that the target droplets TD in the vessel 210 are oxidized by oxygen-containing gas, e.g., $O_2$, $H_2O$, the like. Also, it is less likely that the target material TM in the droplet generator 230 is oxidized. The short refill time and/or the short maintenance time may also increase the spatial stability of the target droplets TD, which is advantageous for a high repetition operation.

In some embodiments, the droplet generator 230 may further include sensors 510 located adjacent to the reservoir 231. For example, the sensors 510 are between the portion 237*b* of the outer shell 237 and the sidewall 231*a* of the reservoir 231. In some embodiments, the droplet generator 230 may further include sensors 520 near the tube 234. The sensors 510 and 520 may detect a condition of the droplet generator, such as a pressure condition, a temperature condition, or the like. The controller 400 is connected with the sensor 500, the heating elements 236*a* and 236*b*, and the temperature control system 300. In some embodiments, the controller 400 may further be connected with the pressurizing device PC.

In some embodiments, the droplet generator 230 may optionally include a charging circuit configured for charging ions into the droplet generator 230. The charging circuit may include an electrode positioned at the bottom wall 231*b* of the reservoir 231. The electrode is connected to ground or connected to a power supply. However, it should be appreciated that many variations and modifications can be made to embodiments of the disclosure. In some other embodiments, the electrode is omitted, and the bottom wall 231*b* and/or the sidewall 231*a* of the reservoir 231 is made of electrically conductive material and is electrically connected to ground or connected to the power supply.

Figure 4:
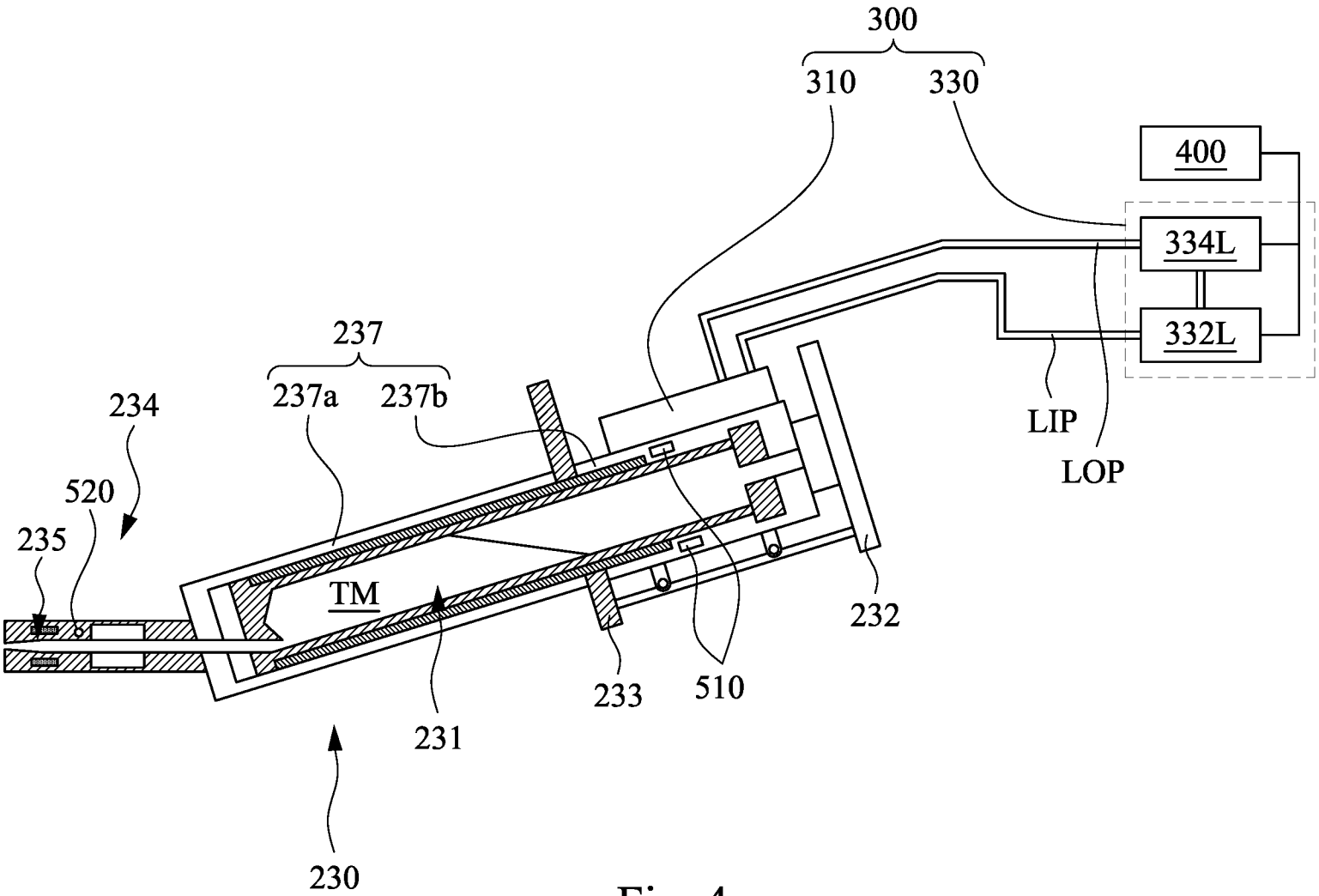
FIG. 4 is a schematic view of a droplet generator assembly according to some embodiments of the present disclosure.

FIG. 4 is a schematic view of a droplet generator assembly according to some embodiments of the present disclosure. The present embodiments are similar to those of FIG. 3, and the difference between the present embodiments of FIG. 4 and the embodiments of FIG. 3 is that the temperature control system 300 includes a liquid input pipe LIP, a liquid output pipe LOP, and an active temperature control device 330 fluidly communicated with the liquid input pipe LIP and the liquid output pipe LOP. The temperature control device 330 includes a liquid heating/cooling element 334L and liquid tank 332L, in which the controller 400 is electrically coupled to the heating/cooling element 334L and the liquid tank 332L for controlling the flow of a liquid. The liquid input pipe LIP and the liquid output pipe LOP may be connected with the heat sink 310 or the portion 237*b* of the outer shell 237. The pipes LIP and LOP may wrap the heat sink 310. For example, the pipes LIP and LOP may be between the fins of the heat sink 310. In some embodiments, the pipes LIP and LOP may surround the heat sink 310 helically. The heating/cooling element 334L may draw heat away from the liquid, thereby cooling the liquid. In some embodiments, the fan device (referring to FIG. 3) may be optionally used to accelerate the heat dissipation. In some embodiments, the active temperature control device 330 may further include a pump fluidly communicated with the pipes LIP and LOP for controlling the liquid flow. In some other embodiments, the heat sink 310 may be omitted.

When the refill process or the prevention maintenance process is performed, a liquid stored in the liquid tank 332L is introduced to adjacent the reservoir 231 though the liquid input pipe LIP, and absorbs the heat of the reservoir 231. Then, the liquid is directed to the heating/cooling element 334L. The heating/cooling element 334L remove the heat of the liquid, and send the liquid to the liquid tank 332L. The liquid may be water, polar liquids, fluorinates, low viscosity oils, other organic liquids, molten salts, molten metals, or other suitable thermally conductive liquid. For example, suitable thermally conductive liquid includes a carrier liquid (e.g., water) dispersed with suitable thermally conductive nanoparticles, such as copper oxide, alumina, titanium dioxide, carbon nanotubes, silica, copper, silver rods, or other metals.

In some embodiments, the heating/cooling element 334L is a cooling system, such as a liquid nitride system, a liquid hafnium system, a cryogenics system, or a water cooling system. In some other embodiments, the heating/cooling element 334L is a heating and cooling system, in which the heating/cooling element 334L may heat or cool the liquid. For example, after the refill process or the prevention maintenance process is performed, the temperature control system 300 may heat the droplet generator 230 by the heating/cooling element 334L. In some other embodiments, the active temperature control device 330 may include a cooling liquid gun ejecting a cooling liquid to the heat sink 310 directly, in which the cooling liquid may absorb the heat of the heat sink 310 and evaporate. For example, the cooling liquid may be water. The cooling liquid gun may be physically separated from the heat sink 310 and the droplet generator 230. In some other embodiments, a pipe (e.g., the pipe LIP) may connect the cooling liquid gun to the heat sink 310, such that the cooling liquid is ejected from the cooling liquid gun to reach the heat sink 310 through the pipe LIP. Other details of the present embodiments are similar to those aforementioned, and not repeated herein.

Figure 5:
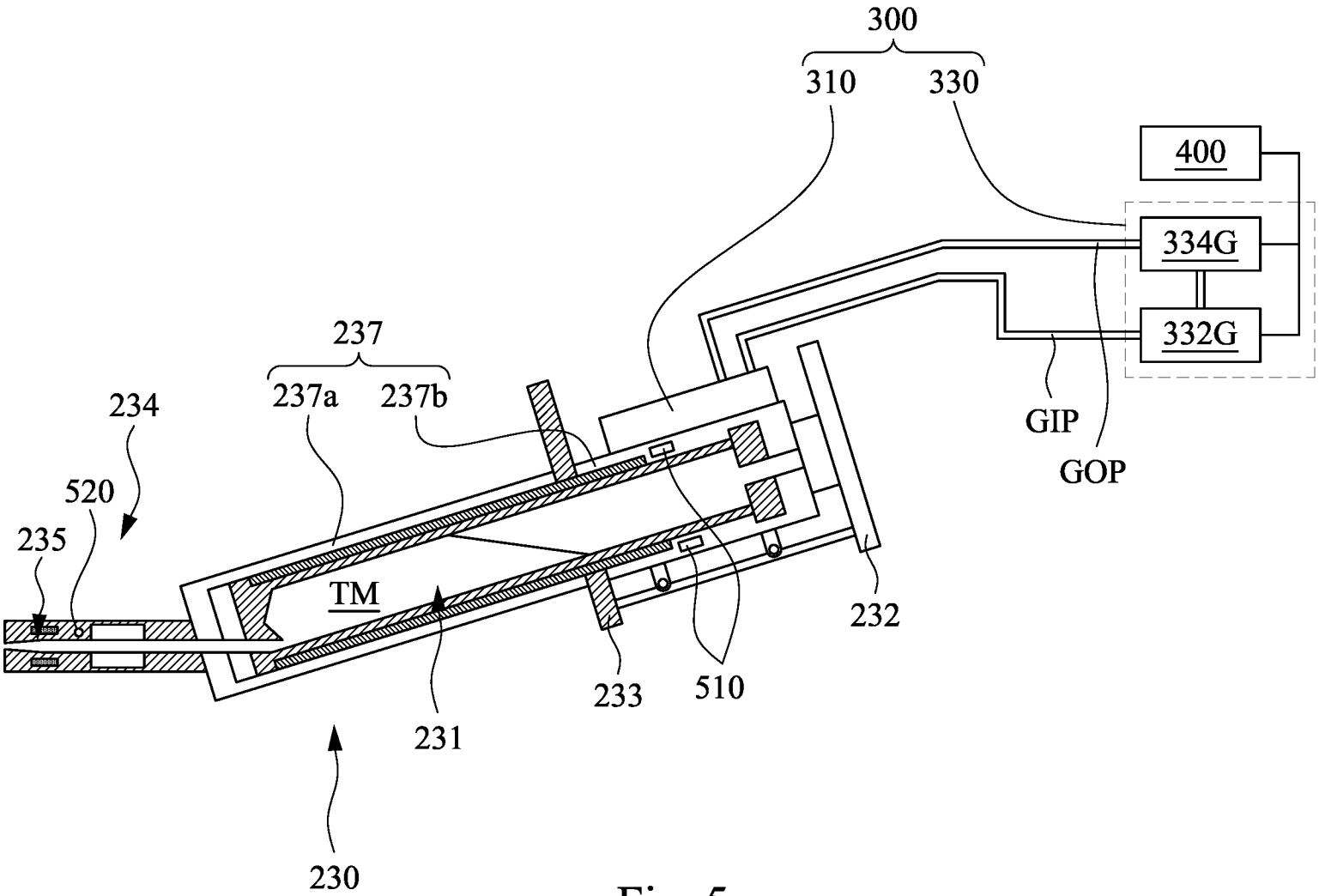
FIG. 5 is a schematic view of a droplet generator assembly according to some embodiments of the present disclosure.

FIG. 5 is a schematic view of a droplet generator assembly according to some embodiments of the present disclosure. The present embodiments are similar to those of FIG. 4, and the difference between the present embodiments of FIG. 5 and the embodiments of FIG. 4 is that: the temperature control system 300 includes a gas input pipe GIP, a gas output pipe GOP, and an active temperature control device 330 including a gas heating/cooling element 334G and a gas tank 332G. The active temperature control device 330 is fluidly communicated with the gas input pipe GIP and the gas output pipe GOP. The controller 400 is electrically coupled to the heating/cooling element 334G and the gas tank 332G for controlling the flow of a gas. The gas input pipe GIP and the gas output pipe GOP may be in contact with the heat sink 310 or the portion 237*b* of the outer shell 237. The pipes GIP and GOP may wrap the heat sink 310. For example, the pipes GIP and GOP may be between the fins of the heat sink 310. In some embodiments, the pipes GIP and GOP may surround the heat sink 310 helically. When the refill process or the prevention maintenance process is performed, a gas stored in the gas tank 332G is introduced to adjacent the reservoir 231 though the gas input pipe GIP, and absorbs the heat of the reservoir 231. Then, the gas is directed to the heating/cooling element 334G through the gas output pipe GOP. The heating/cooling element 334G remove the heat of the gas, and send the gas to the gas tank 332G. The gas may be extreme clean dry air (XCDA). In some embodiments, the gas may be Ar, CO, $CO_2$, H, He, $N_2$, Ne, $O_2$, or other suitable gas. In some embodiments, the fan device (referring to FIG. 3) may be optionally used to accelerate the heat dissipation. In some other embodiments, the heat sink 310 may be omitted.

The heating/cooling element 334G may be a gas thermal exchanger with a compressor, a refrigerant based system (e.g., refrigerator) with a compressor, or the like. For example, by compressing the coolant from a gas state into a liquid state, heat is released from the coolant; by letting the coolant expands from the liquid state into the gas state, the coolant can soak up heat. In some embodiments, the heating/cooling element 334G may be a heating and cooling system, which may conduct a rapid thermal process to heat the droplet generator 230 after the refill process or the prevention maintenance process. For example, the heating/cooling element 334G may heat the gas coming from the gas output pipe GOP, and the heated gas is sent to the heat sink 310 through the gas input pipe GIP. In some embodiments where a rapid thermal process is conducted, the gas may be water vapor. Other details of the present embodiments are similar to those aforementioned, and not repeated herein. In some other embodiments, the active temperature control device 330 may include a cooling gas gun ejecting cooling gas to the heat sink 310 directly. For example, the cooling gas may be nitrogen. The cooling gas gun may be physically separated from the heat sink 310 and the droplet generator 230. In some other embodiments, a pipe (e.g., the pipe GIP) may connect the cooling gas gun to the heat sink 310, such that the cooling gas is ejected from the cooling gas gun to reach the heat sink 310 through the pipe GIP.

Figure 6:
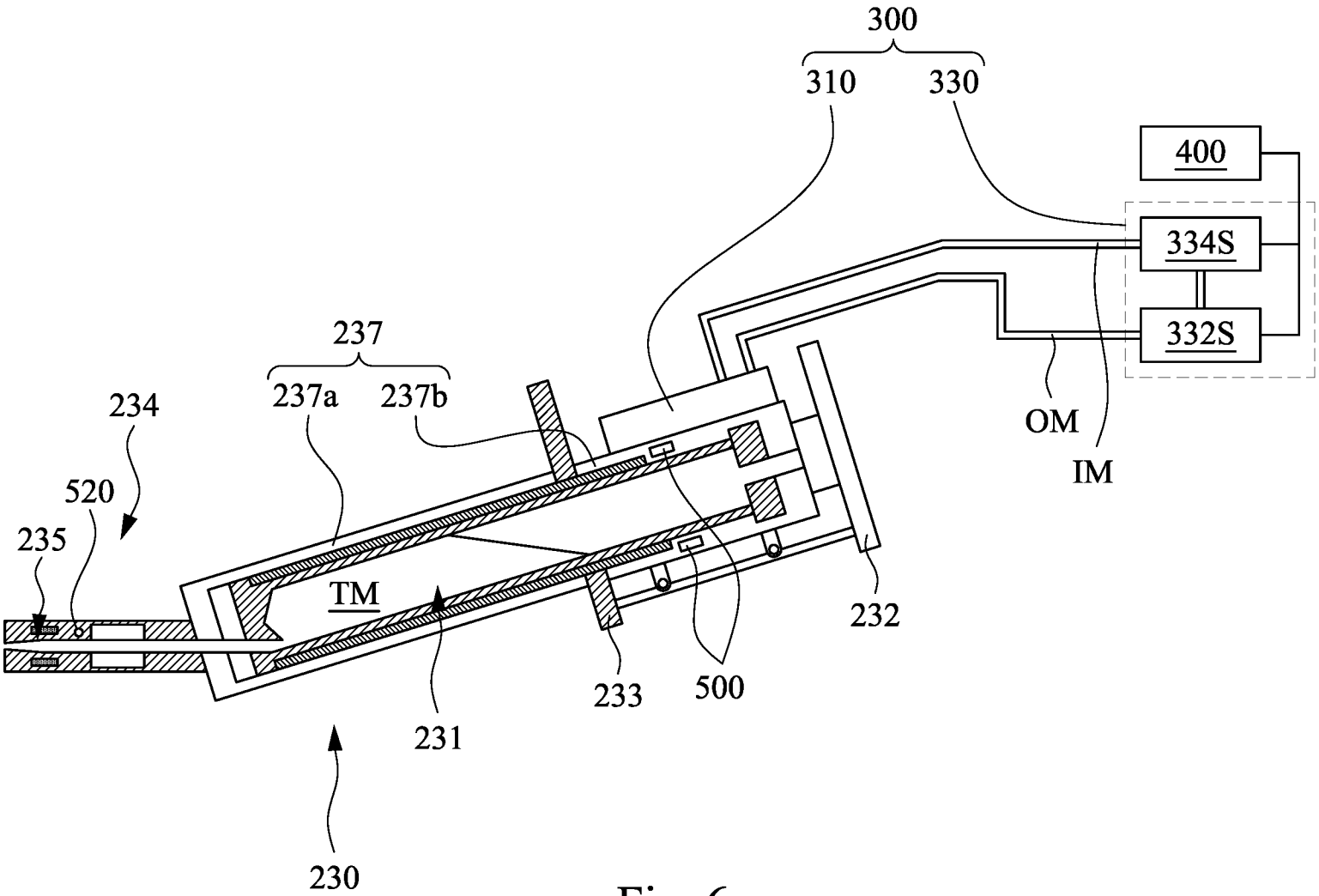
FIG. 6 is a schematic view of a droplet generator assembly according to some embodiments of the present disclosure.

FIG. 6 is a schematic view of a droplet generator assembly according to some embodiments of the present disclosure. The present embodiments are similar to those of FIG. 4, and the difference between the present embodiments and the embodiments of FIG. 4 is that the temperature control system 300 includes thermal conductive wires IM and OM and an active temperature control device 330 including a solid heating/cooling element 334S and a solid tank 332S. The thermal conductive wires IM and OM may be in contact with the heat sink 310 or the portion 237*b* of the outer shell 237. The wires IM and OM may wrap the heat sink 310. For example, the wires IM and OM may be between the fins of the heat sink 310. In some embodiments, the wires IM and OM may surround the heat sink 310 helically. The thermal conductive wires IM and OM are connected to the solid heating/cooling element 334S and the solid tank 332S. The thermal conductive wires IM and OM may be made of Cu, Al, Cu—Al Alloy, Aluminium, Alumina, Copper, Manganese, Marble, Carbon and their combination. The solid heating/cooling element 334S may be a thermoelectric cooling module, such as a thermoelectric cooling chip, and a thermoelectric cooler. In some other embodiments, the solid heating/cooling element 334S may be a thermoelectric cooler and heater, a thermal exchanger with a compressor, a refrigerant based system, or the like. The controller 400 is electrically coupled to the solid heating/cooling element 334S and the solid tank 332S for controlling the heat flow and the rates of heating and cooling.

In some embodiments, the wires OM and IM are made of solid conductive material (e.g., aforementioned Cu, Al, Cu—Al Alloy), and when the refill process or the prevention maintenance process is performed, the thermal conductive wires OM and IM may absorbs the heat of the reservoir 231 and transmits the heat to the solid heating/cooling element 334S. The solid heating/cooling element 334S absorbs and removes the heat of the thermal conductive wire OM, such that the thermal conductive wire OM is capable of continuing absorbing the heat of the reservoir 231. In some embodiments, the passive dissipation device (e.g., the heat sink 310) is thermally coupled to the thermal conductive wire IM and thermal conductive wire OM for drawing heat from the thermal conductive wire IM and thermal conductive wire OM to the ambient, thereby cooling the liquid. In some other embodiments, the wires OM and IM are composited. For example, the wires OM and IM has a hollow tube surrounding by solid conductive walls, and the hollow tube may accommodate liquid or gas for heat transmission. The composited wires OM and IM may be connected to the solid heating/cooling element 334S and the solid tank 332S, respectively. In some embodiments, the fan device (referring to FIG. 3) may be optionally used to accelerate the heat dissipation. In some other embodiments, the heat sink 310 may be omitted.

In some embodiments, the temperature control system 300 may conduct a rapid thermal process to heat or cool the droplet generator 230. For example, the thermal conductive wire IM/OM can be connected to a heating wire, heating rod, heating piece, or the like. In some embodiments, the solid heating/cooling element 334S may act as a heating and cooling element. The droplet generator 230 can be fast controlled between room temperature and the target temperature such as about 300° C. or up to about 2602° C. Other details of the present embodiments are similar to those aforementioned, and not repeated herein.

Figure 7:
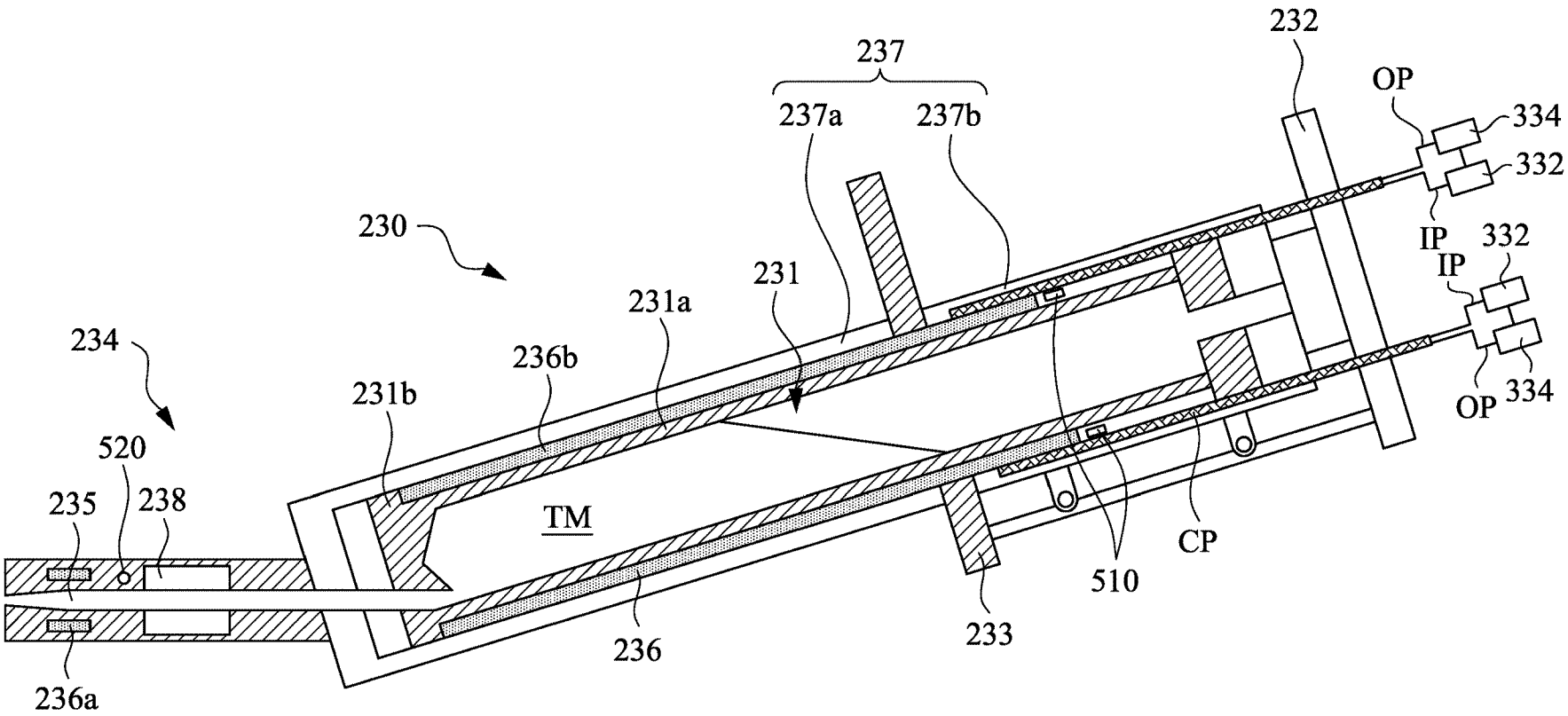
FIG. 7 is a schematic view of a droplet generator assembly according to some embodiments of the present disclosure.

FIG. 7 is a schematic view of a droplet generator assembly according to some embodiments of the present disclosure. The present embodiments are similar to those of FIGS. 4-6, and the difference between the present embodiments and the embodiments of FIG. 4 is that the input pipe IP and the output pipe OP are plugged in between the reservoir 231 and the portion 237*b* of the outer shell 237. In some embodiments, the input pipe IP and the output pipe OP are surrounded by a thermal conductive cover CP, such that heats in the reservoir 231 may transmit to the input pipe IP through the thermal conductive cover CT. The input/output pipe IP/OP may be in the formed of aforementioned liquid input/output pipe LIP/LOP, gas input/output pipe GIP/GOP, or the thermal conductive wires IM/OM. The input pipe IP and the output pipe OP are connected to the tank 332 (e.g., the liquid, gas, or solid tank 332L, 332G, or 332S) and the heating/cooling element 334 (e.g., the heating/cooling element 334L, 334G, or 334S), respectively. Other details of the present embodiments are similar to those aforementioned, and not repeated herein.

Figure 8:
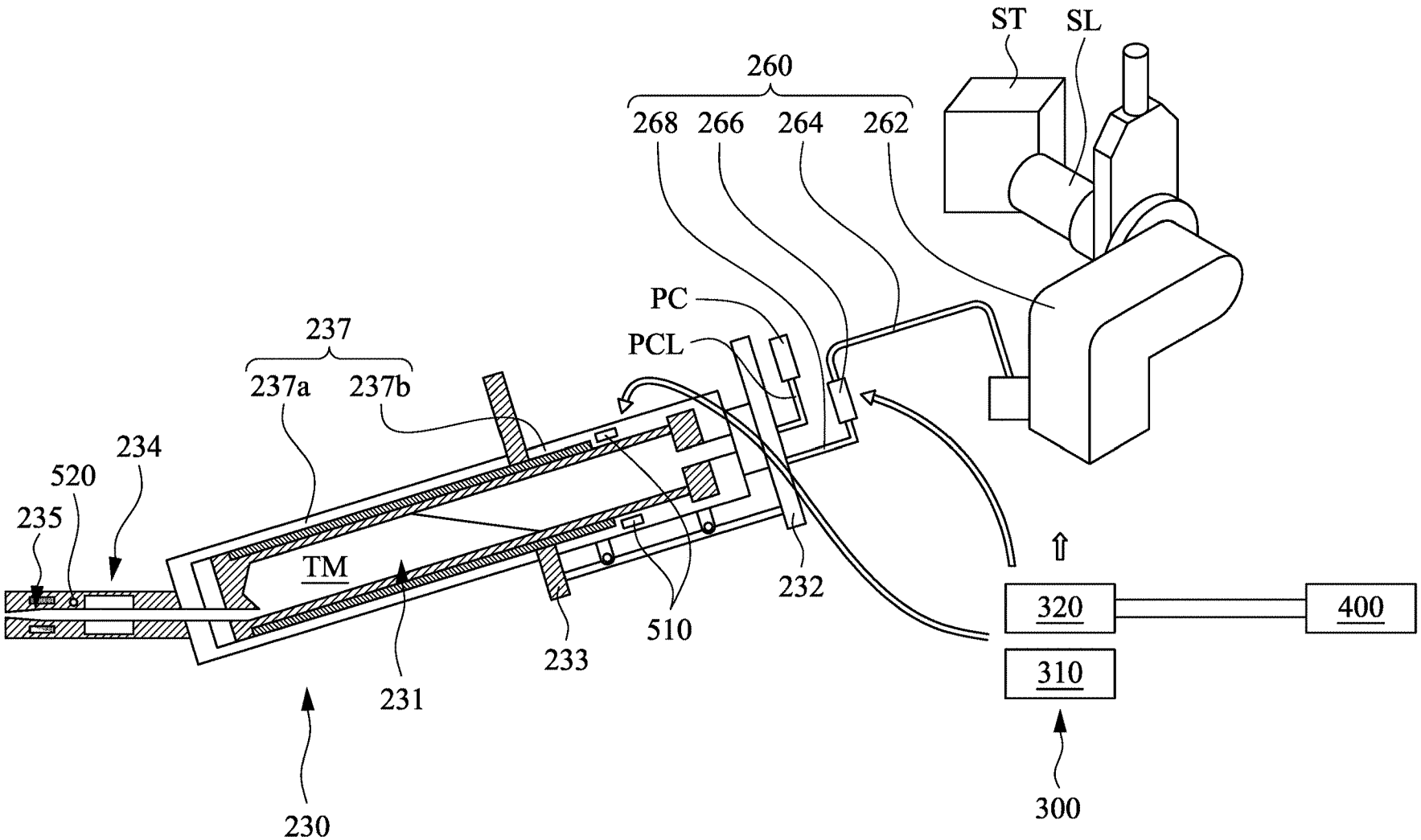
FIG. 8 is a schematic view of a droplet generator assembly according to some embodiments of the present disclosure.

FIG. 8 is a schematic view of a droplet generator assembly according to some embodiments of the present disclosure. The droplet generator assembly of the present embodiments is similar to the droplet generator assembly in FIG. 3, and the difference between droplet generator assembly of the present embodiments and that of FIG. 3 is that the droplet generator assembly may further include a refill system 260, a storage tank ST, and a pressurizing device PC in the present embodiments.

The storage tank ST is configured to contain the target material TM. The target material TM in the storage tank ST is supplied to the droplet generator 230 via a refill system 260. The refill system 260 may include a low-pressure vessel 262, a refill line 264, a high-pressure vessel 266, and a transfer line 268. The low-pressure vessel 262 is coupled to the storage tank ST through a supply line SL. The refill line 264 connects the low-pressure vessel 262 to the high-pressure vessel 266. The transfer line 268 connects the high-pressure vessel 266 to the droplet generator 230. The refill system 260 may further include pumps or valves (not shown in FIG. 8) connected to the vessels 262 and 266 of the refill system 260 to control the pressures in the vessels 262 and 266, thereby controlling the flow of the target material TM. The pressure in the vessels 266 is higher than the pressure in the vessels 262 for directing the target material TM into the reservoir 231. For example, when the refill system 260 operates, the target material TM in the storage tank ST is introduced to the low-pressure vessel 262 through the supply line SL, and flows to the high-pressure vessel 266 through the refill line 264. Then, a pressure in the high-pressure vessel 266 can be manipulated for directing the target material TM into the reservoir 231 of the droplet generator 230. For example, the high-pressure vessel 266 may includes a gas inlet and a gas outlet, and by continuously supplying gas into the vessel 266 through the gas inlet by pump(s) and blocking the gas outlet, the pressure in the vessel 266 increases to be similar to or higher than the pressure in the reservoir 231. Through the configuration, the target material TM in the vessel 266 can be forced out of the vessel 266 and into the reservoir 231 through the transfer line 268.

During the EUV lithography process, the pressurizing device PC may be configured to pressurize the target material TM into the tube 234 for generate droplet of the target material TM. The pressurizing device PC may be a gas supply connected with the reservoir 231 through the gas inlet 2321.

As aforementioned embodiments, the temperature control system 300 may include a heat sink 310 and a fan 320. The controller 400 is connected to the fan 320 for controlling the operation of the fan 320. The temperature control system 300 (e.g., including the heat sink 310 and/or the fan 320) may be over the portion 237*b* of the outer shell 237, the transfer line 268, a portion of a sidewall of the high-pressure vessel 266, and/or a portion of a sidewall of the low-pressure vessel 262. That is, the temperature control system 300 may be used to control a temperature of the refill system 260. Other details of the present embodiments are similar to those aforementioned, and not repeated herein.

Figure 9:
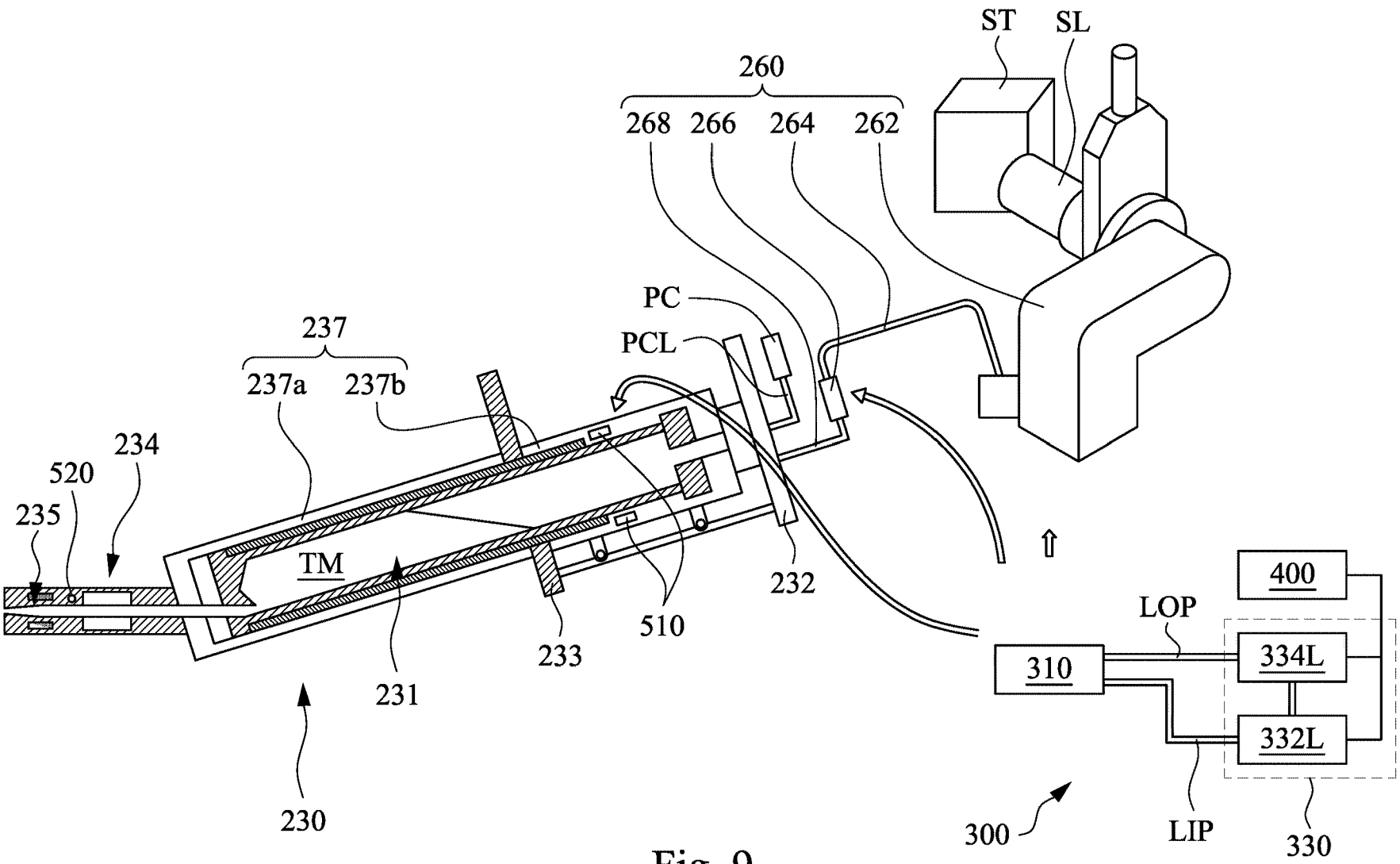
FIG. 9 is a schematic view of a droplet generator assembly according to some embodiments of the present disclosure.

FIG. 9 is a schematic view of a droplet generator assembly according to some embodiments of the present disclosure. The present embodiments are similar to the embodiments of FIG. 8, and the difference between the present embodiments of FIG. 9 and the embodiments of FIG. 8 is that the temperature control system 300 may include liquid pipes LIP and LOP and a temperature control device 330 fluidly communicated with the liquid pipes LIP and LOP. The temperature control device 330 includes a liquid tank 332L and a liquid heating/cooling element 334L as those mentioned in FIG. 4. The temperature control system 300 (e.g., the heat sink 310 and the liquid pipes LIP and LOP) may be near or over the portion 237*b* of the outer shell 237, the transfer line 268, a portion of a sidewall of the high-pressure vessel 266, and/or a portion of a sidewall of the low-pressure vessel 262. For example, the heat sink 310 and the liquid pipes LIP and LOP may be connected to or in contact with the portion 237*b* of the outer shell 237, the transfer line 268, a portion of a sidewall of the high-pressure vessel 266, and/or a portion of a sidewall of the low-pressure vessel 262. Other details of the present embodiments are similar to those aforementioned embodiments, and not repeated herein.

Figure 10:
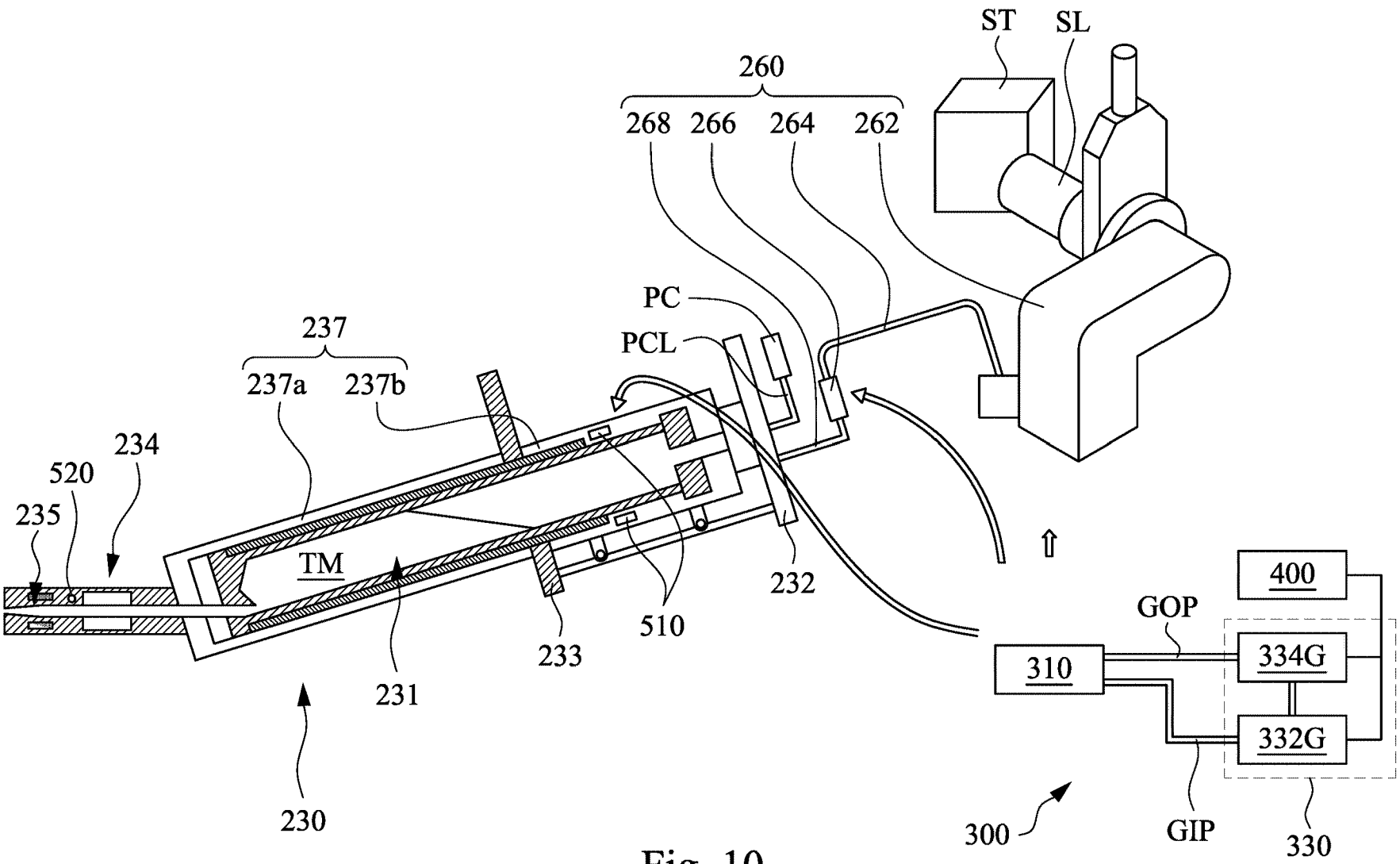
FIG. 10 is a schematic view of a droplet generator assembly according to some embodiments of the present disclosure.

FIG. 10 is a schematic view of a droplet generator assembly according to some embodiments of the present disclosure. The present embodiments are similar to the embodiments of FIG. 9, and the difference between the present embodiments of FIG. 10 and the embodiments of FIG. 9 is that the temperature control system 300 may include gas pipes GIP and GOP and a temperature control device 330 fluidly communicated with the gas pipes GIP and GOP. The temperature control device 330 includes a gas tank 332G and a gas heating/cooling element 334G as those mentioned in FIG. 5. The temperature control system 300 (e.g., the heat sink 310 and the gas pipes GIP and GOP) may be near or over the portion 237*b* of the outer shell 237, the transfer line 268, a portion of a sidewall of the high-pressure vessel 266, and/or a portion of a sidewall of the low-pressure vessel 262. For example, the heat sink 310 and the gas pipes GIP and GOP may be connected to or in contact with the portion 237*b* of the outer shell 237, the transfer line 268, a portion of a sidewall of the high-pressure vessel 266, and/or a portion of a sidewall of the low-pressure vessel 262. Other details of the present embodiments are similar to those aforementioned embodiments, and not repeated herein.

Figure 11:
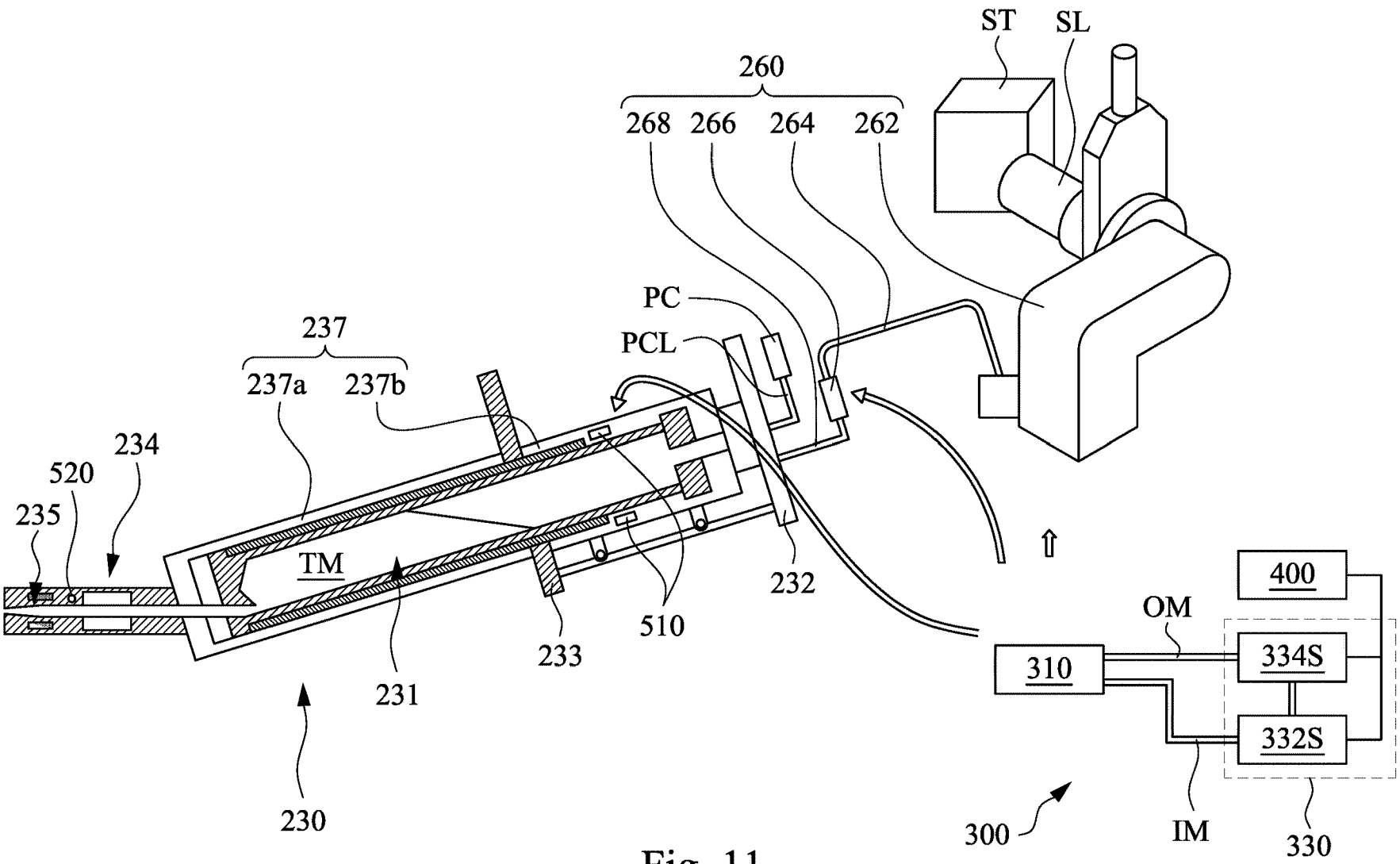
FIG. 11 is a schematic view of a droplet generator assembly according to some embodiments of the present disclosure.

FIG. 11 is a schematic view of a droplet generator assembly according to some embodiments of the present disclosure. The present embodiments are similar to the embodiments of FIG. 9, and the difference between the present embodiments of FIG. 10 and the embodiments of FIG. 9 is that the temperature control system 300 may include wires IM and OM and a temperature control device 330 connected with the wires IM and OM. The temperature control device 330 includes a solid tank 332S and a solid heating/cooling element 334S as those mentioned in FIG. 6. The temperature control system 300 (e.g., the heat sink 310 and the wires IM and OM) may be near or over the portion 237*b* of the outer shell 237, the transfer line 268, a portion of a sidewall of the high-pressure vessel 266, and/or a portion of a sidewall of the low-pressure vessel 262. For example, the heat sink 310 and the wires IM and OM may be connected to or in contact with the portion 237*b* of the outer shell 237, the transfer line 268, a portion of a sidewall of the high-pressure vessel 266, and/or a portion of a sidewall of the low-pressure vessel 262. Other details of the present embodiments are similar to those aforementioned, and not repeated herein.

Figure 12:
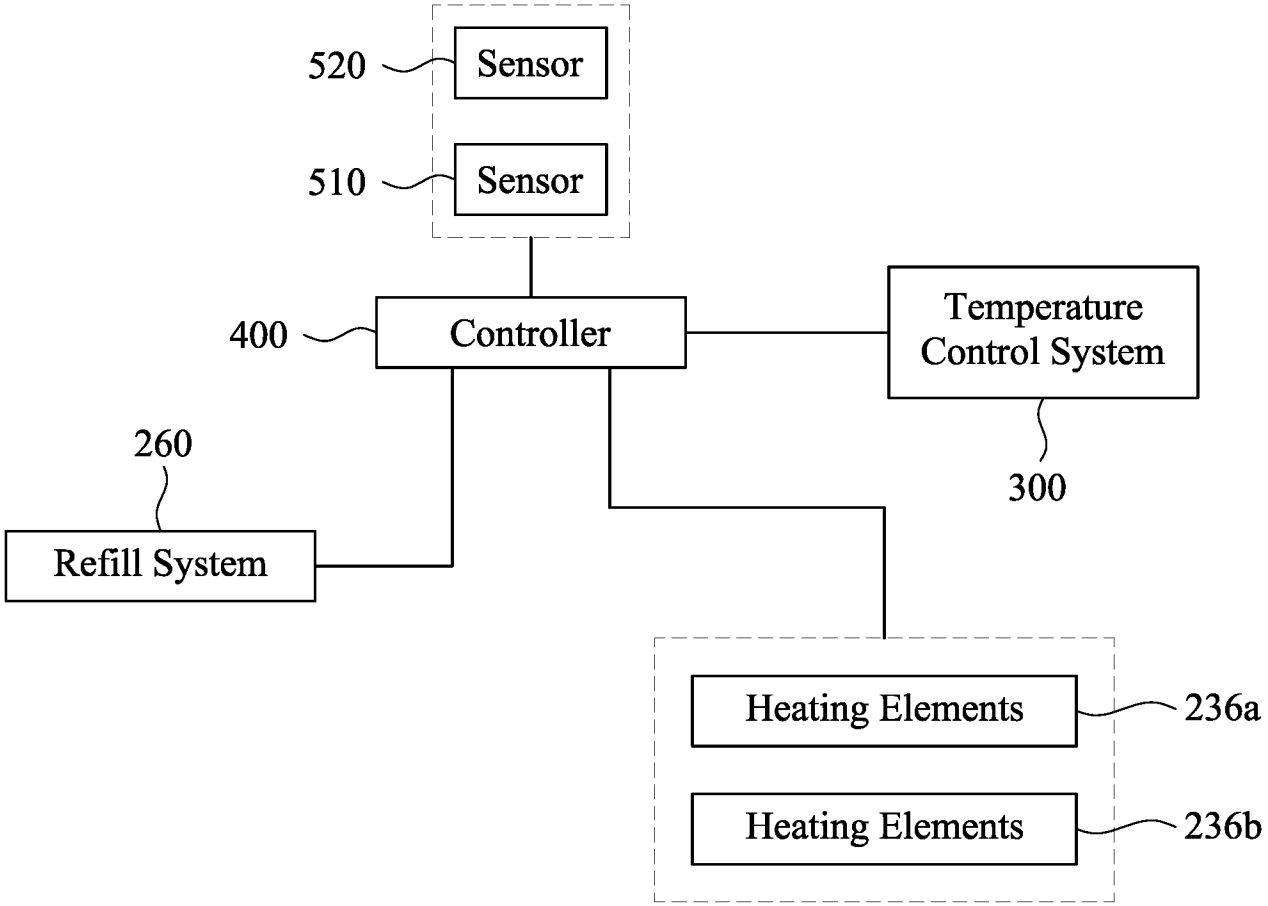
FIG. 12 is a block diagram of a droplet generator assembly according to some embodiments of the present disclosure.

FIG. 12 is a block diagram of a droplet generator assembly according to some embodiments of the present disclosure. Reference is made to FIGS. 9 and 12. As aforementioned, the sensor 500 may detect a condition of the droplet generator, such as a pressure condition, a temperature condition, or the like. The controller 400 is connected with the sensor 500, the heating elements 236*a* and 236*b*, the refill system 260, and the temperature control system 300. In some embodiments, the controller 400 may further be connected with the pressurizing device PC for control the droplets of the target material TM into the vessel 210. Through the configuration, the controller 400 may receive a signal from the sensors 510 and 520, and determine whether to perform a refill process or whether to perform a prevention maintenance process according to the signal from the sensor 500. For example, if the pressure measured by the sensor 520 is too high, the nozzle may be clogged, and the prevention maintenance process would be conducted. In the prevention maintenance process, the controller 400 may control the temperature control system 300 to reduce the temperature of the reservoir 231 and the tube 234 (e.g., the nozzle 235) until a temperature detected by the sensor 510 is low enough to manually move the droplet generator assembly. Alternatively, if the pressure measured by the sensor 520 is too low, the target material may be exhausted, and the refill process would be conducted. In the refill process, the controller 400 may control the temperature control system 300 to reduce the temperature of the reservoir 231 until a temperature detected by the sensor 510 is low enough to manually refill the target material. In some embodiments, the controller 400 may control the refill system 260 to refill the target material, and the temperature of the reservoir 231 may be kept above the melting point of the target material TM during the refill process.

Figure 13:
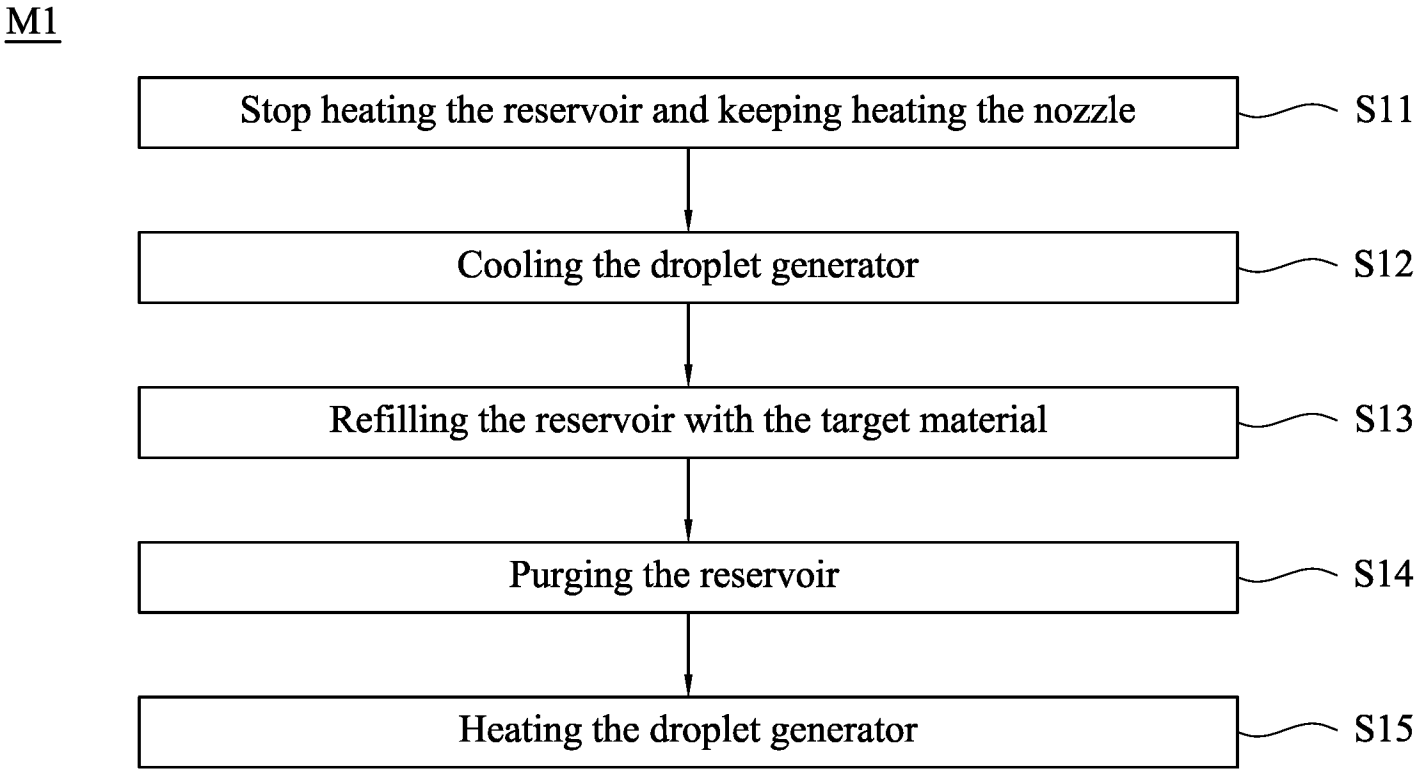
FIG. 13 is a method for refilling a target material to a droplet generator assembly according to some embodiments of the present disclosure.

FIG. 13 is a method M1 for refilling a target material TM to a droplet generator assembly according to some embodiments of the present disclosure. The method M1 includes steps S11-S15. The illustration is merely exemplary and is not intended to limit beyond what is specifically recited in the claims that follow. It is understood that additional steps may be provided before, during, and after the steps shown by FIG. 13, and some of the steps described below can be replaced or eliminated in additional embodiments of the method. The order of the operations/processes may be interchangeable. Reference is made to both FIGS. 3 and 13. During the refill process, at step S11, under the control of the controller 400, the heating elements 236*b* are turned off, while the heating elements 236*a* keep heating the nozzle 235 for protecting the nozzle 235 from clogging. At step S12, the temperature control system 300 cools the reservoir 231 of the droplet generator 230 down to a refill temperature (e.g., the temperature point $T_F$ in FIG. 15B). At step S13, operators refill the target material TM into the reservoir 231 of the droplet generator 230. In some embodiments, the controller 400 may control the refill system 260 to deliver the target material TM into the reservoir 231, and the step S12 (i.e., the cooling step) may be omitted in some embodiments. At step S14, the reservoir 231 of the droplet generator 230 is purged for removing oxide-containing gas, thereby preventing the target material TM from oxidation. At step S15, under the control of the controller 400, the heating elements 236*b* are turned on to heat the reservoir 231 of the droplet generator 230. In some embodiments, at step S15, the temperature control system 300 may also be controlled to heat the reservoir 231.

Figure 14:
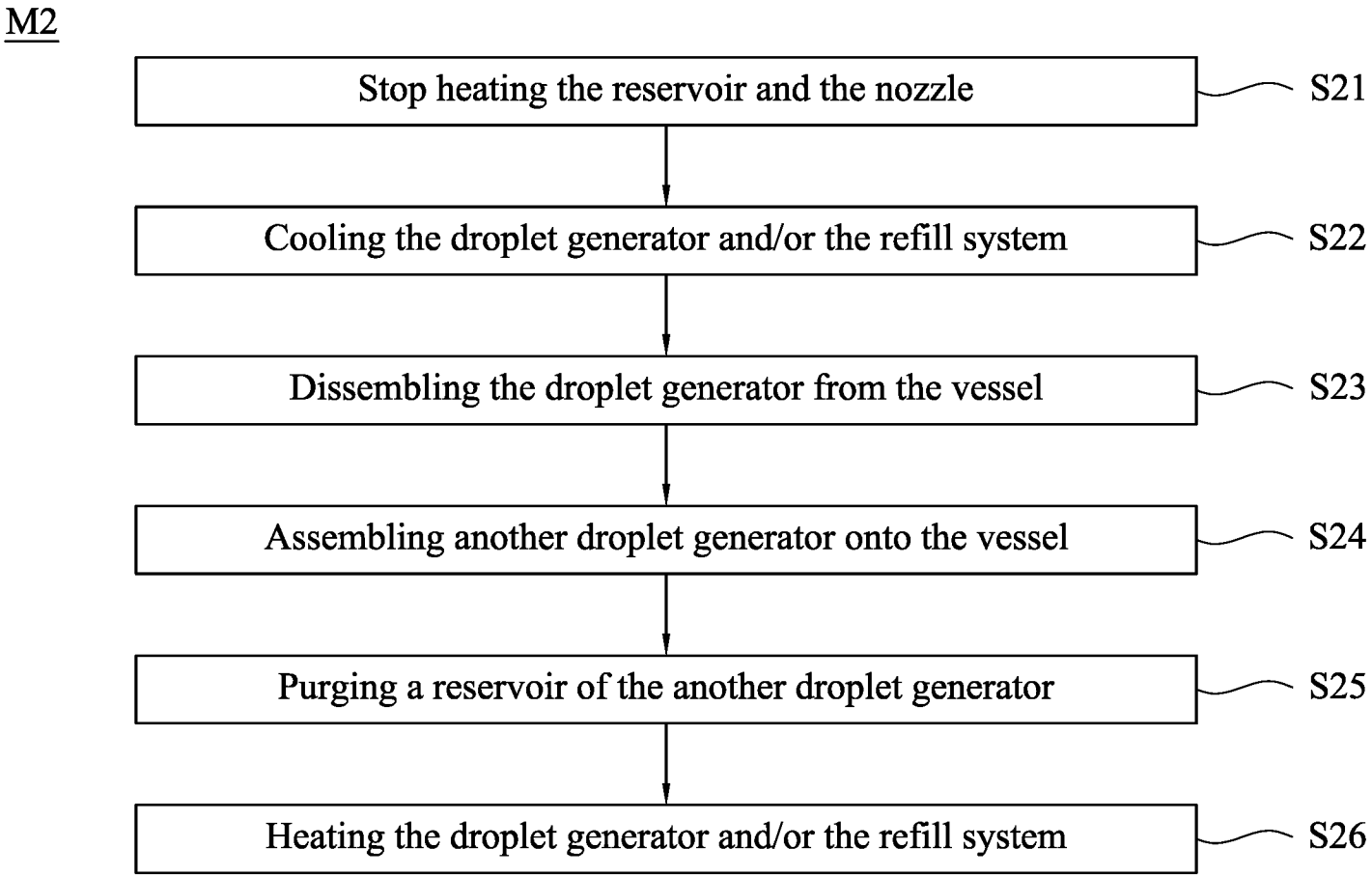
FIG. 14 is a method for prevention maintenance of a droplet generator assembly according to some embodiments of the present disclosure.

FIG. 14 is a method M2 for prevention maintenance of a droplet generator assembly according to some embodiments of the present disclosure. The method M2 includes steps S21-S26. The illustration is merely exemplary and is not intended to limit beyond what is specifically recited in the claims that follow. It is understood that additional steps may be provided before, during, and after the steps shown by FIG. 14, and some of the steps described below can be replaced or eliminated for additional embodiments of the method. The order of the operations/processes may be interchangeable. Reference is made to both FIGS. 3 and 14. After being used for several weeks, the nozzle of the droplet generator 230 may clog and does not work, and a prevention maintenance process is performed for replacing the droplet generator 230 having the clogged nozzle with another droplet generator 230 having a clean nozzle.

As shown in step S21, under the control of the controller 400, the heating elements 236*a* and 236*b* are turned off. At step S22, the temperature control system 300 cools the reservoir 231 of the droplet generator 230 and/or the refill system 260 down to a maintenance temperature (e.g., the temperature point $T_M$), such that operators may approach and touch the droplet generator 230. At step S23, the droplet generator 230 having the clogged nozzle is dissembled from the vessel 210 by operators. At step S24, another generator 230 having a clean nozzle is assembled onto the vessel 210 by operators. At step S25, the reservoir 231 of the another droplet generator 230 is purged for removing oxide-containing gas, thereby preventing the target material TM from oxidation. At step S26, under the control of the controller 400, the heating elements 236*a* and 236*b* are turned on to heat the nozzle 235 and the reservoir 231 of the droplet generator 230. In some embodiments, at step S26, the temperature control system 300 may also be controlled to heat the reservoir 231.

Figure 15B:
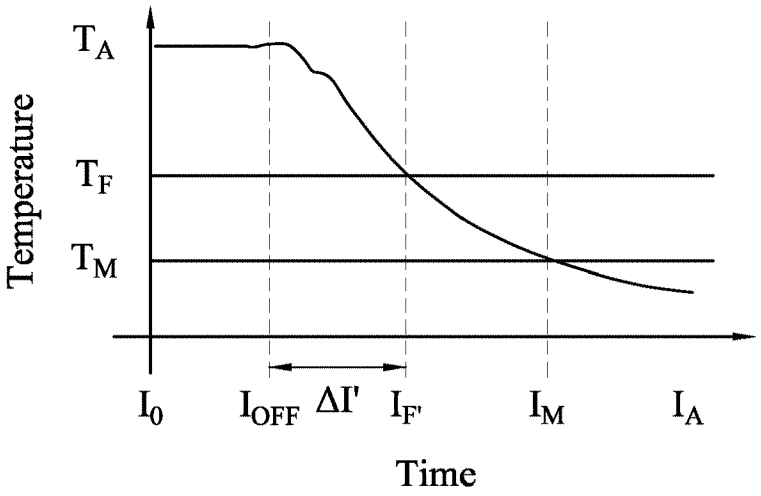
FIGS. 15A and 15B are experiment results according to some embodiments of the present disclosure.
Figure 15A:
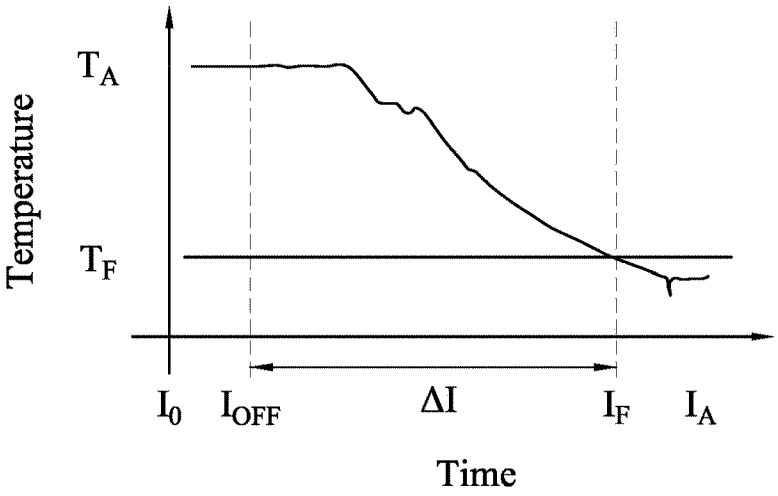

FIG. 15A is an experiment result of naturally cooling a droplet generator according to some embodiments of the present disclosure. FIG. 15B is an experiment result of cooling a droplet generator with a fan (e.g., fan 320 in FIG. 3) according to some embodiments of the present disclosure. At timing $I_0$. the droplet generator assembly operates at a temperature $T_A$ above a melting point of the target material (e.g., tin). At timing $I_{OFF}$, the droplet generator assembly stops working, the heating elements 236*b* are turned off, and a temperature of the reservoir of the droplet generator starts to decrease. The refilling temperature $T_F$ is where the refill process may be performed. The maintenance temperature $T_M$ is where the maintenance process may be performed. The refilling temperature $T_F$ and maintenance temperature $T_M$ are below the melting point of the target material.

In FIG. 15A, it takes a time duration ΔI for naturally decreasing the temperature of the reservoir of the droplet generator from the temperature $T_A$ to the refilling temperature $T_F$. In FIG. 15B, with the temperature control system (e.g., the fan and the heat sink), it takes a time duration ΔI' for decreasing the temperature of the reservoir from the temperature $T_A$ to the refilling temperature $T_F$, in which the time duration ΔI' is much less than the time duration ΔI. That is, with the configuration of the temperature control system, the reservoir of the droplet generator can be quickly cooled, such that the refill process (and the prevention maintenance process) take less process time. The labels $I_F$ and $I_F'$, and $I_M$ indicate the timing that the temperature of the reservoir reaches the refilling temperature $T_F$ and the maintenance temperature $T_M$, respectively. The labels IA are used for showing that the horizontal scales of FIGS. 15A and 15B are substantially the same.

Based on the above discussions, it can be seen that the present disclosure offers advantages. It is understood, however, that other embodiments may offer additional advantages, and not all advantages are necessarily disclosed herein, and that no particular advantage is required for all embodiments. One advantage is that refill process and the prevention maintenance process take less process time, such that the yield rate is increased. Another advantage is that the contamination or particles in the EUV vessel or on the collector can be effectively reduced due to the short refill time and/or the short maintenance time. Still another advantage is that, due to the short refill time and/or the short maintenance time, it is less likely that the target droplets in the EUV vessel are oxidized. Also, it is less likely that the target material in the droplet generator is oxidized. Still another advantage is that the short refill time and/or the short maintenance time may also increase the spatial stability of the target droplets, which is advantageous for a high repetition operation.

According to some embodiments of the present disclosure, a droplet generator assembly includes a storage tank, a refill system, a droplet generator, and a temperature control system. The storage tank is configured to store a target material. The refill system is connected to the storage tank. The droplet generator includes a reservoir and a nozzle connected to the reservoir, in which the droplet generator is connected to the refill system, and the refill system is configured to deliver the target material to the reservoir. The temperature control system is adjacent to the refill system or the reservoir.

According to some embodiments of the present disclosure, a radiation source apparatus includes a vessel, a droplet generator, and a temperature control system. The droplet generator is detachably mounted on the vessel. The droplet generator includes a reservoir, a nozzle connected to the reservoir, and an outer shell accommodating the reservoir, and the outer shell has a first portion inserted into the vessel and a second portion extending out of the vessel when the droplet generator is mounted on the vessel. The temperature control system is on the second portion of the outer shell and configured to cool the reservoir.

According to some embodiments of the present disclosure, a method includes heating a target material in a reservoir; generating a target droplet from the heated target material; impinging a laser onto the target droplet for producing extreme violet light; and cooling down the reservoir.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method, comprising:

heating a first target material in a reservoir;

generating a target droplet from the heated first target material from a nozzle connected to the reservoir into a vessel;

impinging a laser onto the target droplet for producing extreme violet light out of the vessel; and cooling down the reservoir by using a cooling device, wherein cooling down the reservoir is performed at least with a fan of the cooling device.

2. The method of claim 1, further comprising:

filling the reservoir with a second target material after cooling down the reservoir, wherein the second target material comprises the same material as that of the first target material.

3. The method of claim 1, further comprising:

assembling a first droplet generator comprising the reservoir and the nozzle onto the vessel before heating the first target material; and disassembling the first droplet generator from the vessel after cooling down the reservoir.

4. The method of claim 3, further comprising:

assembling a second droplet generator onto the vessel after disassembling the first droplet generator from the vessel.

5. The method of claim 3, wherein disassembling the first droplet generator from the vessel is performed when a temperature of the reservoir of the first droplet generator is lower than a melting point of the first target material.

6. The method of claim 3, further comprising:

cooling down the nozzle before disassembling the first droplet generator from the vessel.

7. The method of claim 2, wherein filling the reservoir with the second target material is performed when a temperature of the reservoir is lower than a melting point of the first target material.

8. The method of claim 2, further comprising:

keeping the nozzle at a temperature higher than a melting point of the first target material when filling the reservoir with the second target material.

9. The method of claim 2, further comprising:

purging the reservoir after filling the reservoir with the second target material.

10. The method of claim 1, wherein cooling down the reservoir is performed with a heat sink of the cooling device.

11. The method of claim 1, further comprising:

assembling a first droplet generator comprising the reservoir and the nozzle onto the vessel before heating the first target material, wherein the first droplet generator has a first portion in the vessel and a second portion external to the vessel, and the cooling device is adjacent to the second portion of the first droplet generator.

12. The method of claim 11, wherein the cooling device is in contact with the second portion of the first droplet generator.

13. A method, comprising:

assembling a droplet generator comprising a reservoir and a nozzle onto a vessel, wherein the droplet generator has a first portion in the vessel and a second portion external to the vessel;

arranging a temperature control device adjacent to the second portion of the droplet generator, wherein the temperature control device is external to the vessel; and heating or cooling a target material in the reservoir of the droplet generator by the temperature control device.

14. The method of claim 13, wherein arranging the temperature control device is performed such that the temperature control device is in contact with the second portion of the droplet generator.

15. A method, comprising:

heating a first target material in a reservoir of a droplet generator;

generating a target droplet from the heated first target material from the droplet generator into a vessel;

impinging a laser onto the target droplet for producing extreme violet light out of the vessel; and filling, by using a refill system, the reservoir of the droplet generator with a second target material when a temperature of the reservoir is higher than a melting point of the first target material, wherein the second target material comprises the same material as that of the first target material, wherein the refill system comprises a first refill vessel, a second refill vessel, a refill line connected between the first refill vessel and the second refill vessel, and a transfer line connected between the second refill vessel and the reservoir of the droplet generator, and filling the reservoir of the droplet generator with the second target material comprises causing the second target material flowing from the first refill vessel to the reservoir of the droplet generator through the refill line, the second refill vessel, and the transfer line.

16. The method of claim 15, wherein filling the reservoir of the droplet generator with the second target material is performed when the droplet generator is mounted on the vessel.

17. The method of claim 15, further comprising:

using a temperature control system to control a temperature of the refill system, thereby heating the second target material prior to filling the reservoir with the second target material.

18. The method of claim 15, further comprising:

cooling down the refill system using a temperature control system; and disassembling the droplet generator from the vessel after cooling down the refill system.

19. The method of claim 13, wherein the droplet generator comprises a holder between the first portion of the droplet generator and the second portion of the droplet generator, and assembling the droplet generator onto the vessel is performed such that the holder is aligned with an edge of the vessel.

20. The method of claim 13, wherein at least a portion of the temperature control device faces a sidewall of the second portion of the droplet generator.

* * * * *